US008322722B1

(12) United States Patent
Criswell

(10) Patent No.: US 8,322,722 B1
(45) Date of Patent: Dec. 4, 2012

(54) RANDOM NUMBER SELECTOR DEVICE

(76) Inventor: Timothy D. Criswell, Wilburton, OK (US)

( * ) Notice: Subject to any disclaimer, the term of this patent is extended or adjusted under 35 U.S.C. 154(b) by 119 days.

(21) Appl. No.: 12/944,217

(22) Filed: Nov. 11, 2010

(51) Int. Cl.
*A63F 71/00* (2006.01)

(52) U.S. Cl. ..... 273/144 B

(58) Field of Classification Search ..... None
See application file for complete search history.

(56) References Cited

U.S. PATENT DOCUMENTS 3,674,275 A * 7/1972 Samson ..... 273/138.4
3,688,090 A * 8/1972 Rankin ..... 235/70 R
4,185,828 A * 1/1980 Fernandez ..... 273/142 J
4,508,346 A * 4/1985 Salvucci ..... 273/144 B
4,541,630 A * 9/1985 Dirks ..... 273/144 B
4,583,736 A * 4/1986 Lorraine ..... 273/144 B
4,601,471 A * 7/1986 Frank ..... 273/144 B
4,732,387 A * 3/1988 Elinski ..... 273/144 A
4,778,182 A * 10/1988 Brignole ..... 273/144 A
4,786,056 A * 11/1988 Dunnigan ..... 273/144 A
4,822,048 A * 4/1989 Axup ..... 273/144 B
4,846,476 A 7/1989 Hanna
4,861,032 A * 8/1989 Gaylor ..... 273/144 B
5,062,635 A 11/1991 Tse et al.
5,121,920 A * 6/1992 Laezzo et al. ..... 273/144 B
D331,782 S 12/1992 Delgrange
5,419,557 A 5/1995 Kirkland et al.
5,725,212 A * 3/1998 Garrett ..... 273/144 R
6,106,394 A * 8/2000 Furlong ..... 463/20
6,145,836 A 11/2000 Toulemonde et al.
6,152,448 A * 11/2000 Cudlipp ..... 273/144 R
7,780,166 B1 * 8/2010 Paxton et al. ..... 273/145 C

* cited by examiner

*Primary Examiner* — Alvin Hunter
*Assistant Examiner* — Dolores Collins

(57) ABSTRACT

A random number selector device featuring a hollow globe with globe air apertures disposed in the top end and a plurality of balls disposed in the inner cavity. A base supports the globe. Side apertures are disposed the side and base air apertures are disposed in the top of the base. A fan and motor are disposed in the base. The fan and motor draw air into the base and push air out of the base via the base air, apertures. Air flow causes the balls to move around randomly. A tube adapted to collect the balls is disposed on the globe. A spring-loaded tube cover can pivot between a first position and a second position respectively allowing and preventing access to the selector tube. A release lever manipulates the tube cover.

9 Claims, 5 Drawing Sheets

RANDOM NUMBER SELECTOR DEVICE

FIELD OF THE INVENTION

The present invention is directed to a device capable of picking a series of random numbers for purposes including but not limited to lotteries.

BACKGROUND OF THE INVENTION

Electronic number generators for things such as lotteries are generally very expensive. The present invention features a random number selector for generating random numbers for lotteries or other purposes. The random number selector device of the present invention is portable and less expensive as compared to electronic number generators.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a random number selector device comprising a generally spherical and hollow globe, wherein a plurality of globe air apertures, is disposed in a top end of the globe and a bottom end of the globe is either open or comprises globe air apertures; a plurality of balls of equal weight and size, each ball is labeled with a number, each ball is housed in an inner cavity of the globe; a base for supporting the globe, a concave indentation is disposed in a top surface of the base to accommodate the bottom end of the globe, a plurality of side apertures is disposed in a side surface of the base, a plurality of base air apertures is disposed in the concave indentation, the base air apertures allow flow of air from the inner cavity of the base into the inner cavity of the globe whereupon air can exit the globe via the globe air apertures in the top end of the globe, wherein air flow in the inner cavity of the globe causes the balls to randomly move around; a fan disposed in an inner cavity of the base, a motor is operatively connected to the fan, the fan and motor together function to draw air into the base via the side air apertures and push air out of the base via the base air apertures; a hollow selector tube having a first end and a second end, the first end being attached to a side area of the globe, the selector tube is fluidly connected to the inner cavity of the globe, the selector tube is sized to allow passage of a ball from the inner cavity of the globe; a tube cover disposed in the globe at an intersection of the first end of the selector tube and the globe, the tube cover can pivot between a first position and a second position respectively allowing and preventing access to the selector tube, the tube cover is biased in the second position caused by a spring; a release lever attached to the tube cover, the release lever can be pushed causing the tube cover to move to the first position and when the release lever is released the spring causes the tube cover to move back to the second position; and a power switch for turning the device on and off.

In some embodiments, the device further comprises a cap disposed on the second end of the selector tube. In some embodiments, the device further comprises cap apertures disposed in the cap allowing air to flow out from the selector tube. In some embodiments, the cap is removably attached to the second end of the selector tube.

In some embodiments, the motor is operatively connected to a power source. In some embodiments, the power source is a battery or an electrical outlet. In some embodiments, the selector tube is removably attached to the globe. In some embodiments, the selector tube is pivotally attached to the globe. In some embodiments, the selector tube is generally curved. In some embodiments, the device further comprises a connector piece connecting an area of the selector tube at or near the second end of the selector tube to the globe.

DESCRIPTION OF PREFERRED EMBODIMENTS

Referring now to FIGS. 1-6, the present invention features a random number selector device 100 for generating random numbers for lotteries or other purposes. The random number selector device 100 of the present invention comprises a generally spherical and hollow globe 110 having a top end, a bottom end, and an inner cavity. A plurality of globe air apertures 118 is disposed in the top end of the globe 110. In some embodiments, the bottom end of the globe 110 is open. In some embodiments, globe air apertures are disposed in the bottom end of the globe 110. The inner cavity is for housing a plurality of balls 150. The balls 150 are each labeled with a number. The balls 150 are equal in weight and size.

Figure 2:
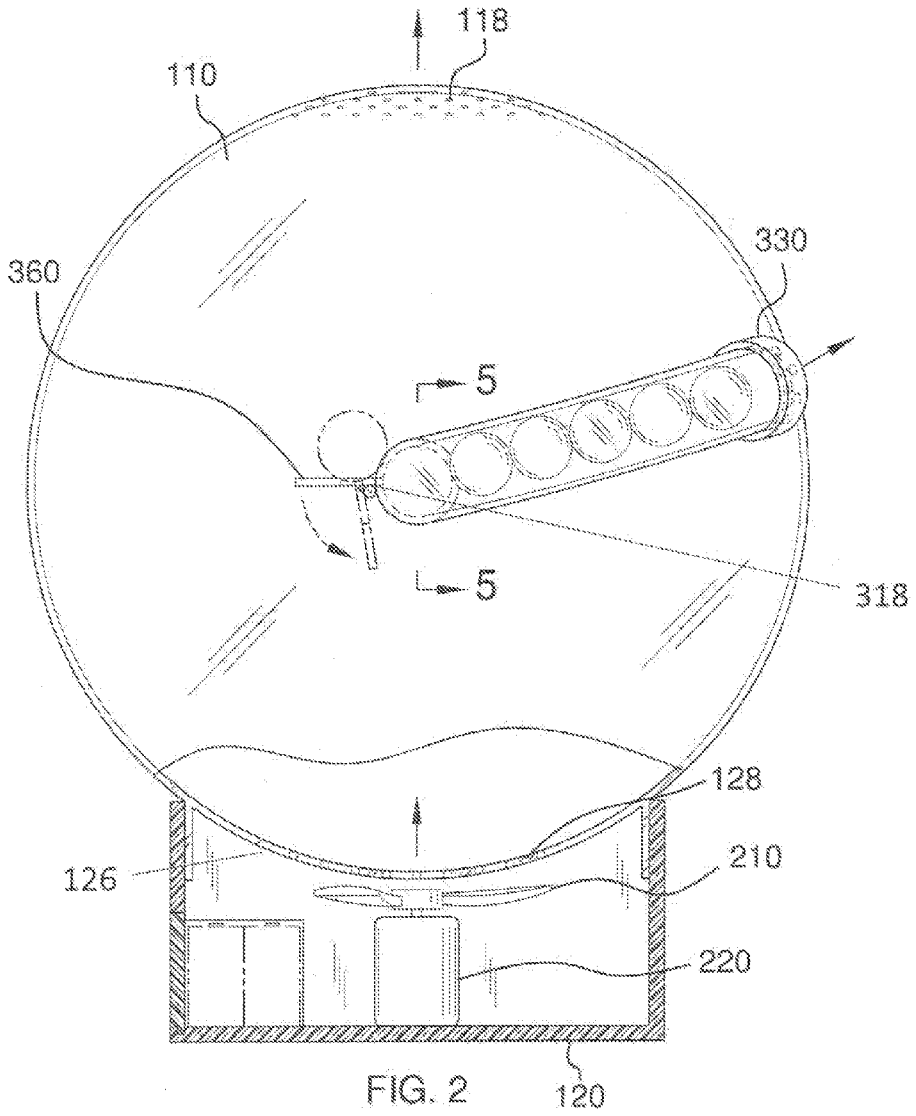
FIG. 2 is a side cross sectional view of the random number selector device of the present invention.

The device 100 of the present invention further comprises a base 120 for supporting the globe 110. The base 120 has a top surface, a bottom surface, side surfaces, and an inner cavity. In some embodiments, a concave indentation 126 is disposed in the top surface of the base 120 to accommodate the globe 110 (the bottom end of the globe 110). FIG. 2 is a side cross sectional view of the device 100 of the present invention showing the bottom end of the globe 110 positioned in the concave indentation 126. A plurality of base air apertures 128 is disposed in the concave indentation 126. The base air apertures 128 allow flow of air from the inner cavity of the base 120 into the inner cavity of the globe 110 (e.g., via the open bottom end of the globe 110 or via globe air apertures in the bottom end of the globe 110). The flow of air causes the balls 150 in the inner cavity of the globe 110 to randomly move around. Air an exit the inner cavity of the globe via the globe air apertures 118.

Figure 6:
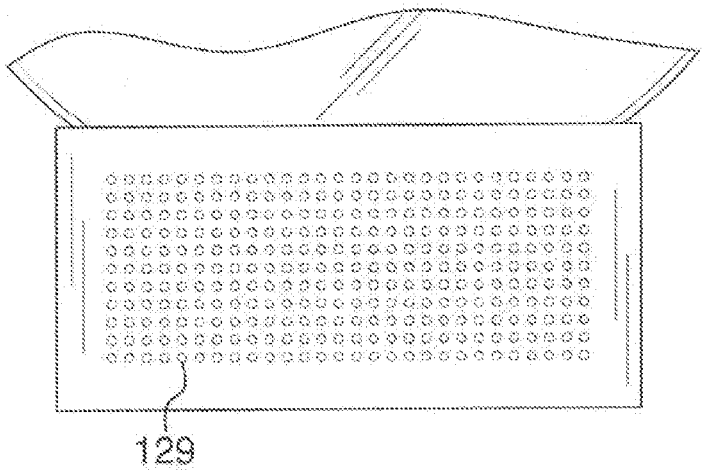
FIG. 6 is a partial back view of the random number selector device of the present invention.

Disposed in the inner cavity of the base 120 is a fan 210 operatively connected to a motor 220. The fan 210 and motor 220 function to push air out of the base 120 via the base air apertures 128 (and into the inner cavity of the globe 110). As shown in FIG. 6, a plurality of side apertures 129 is disposed in a side, surface of the base 120. The side apertures 129 allow air to be drawn into the inner cavity of the base 120.

The motor 220 is operatively connected to a power source. In some embodiments, the power source is a battery. In some embodiments, the power source is an electrical outlet (e.g., a power cord operatively connects the motor 220 to an electrical outlet. In some embodiments, a battery compartment 230 is disposed in the base 120 for housing one or more batteries. The device 100 also features a power switch 240 for turning the device on and off. The power switch 240 may be disposed on the base 120.

Figure 1:
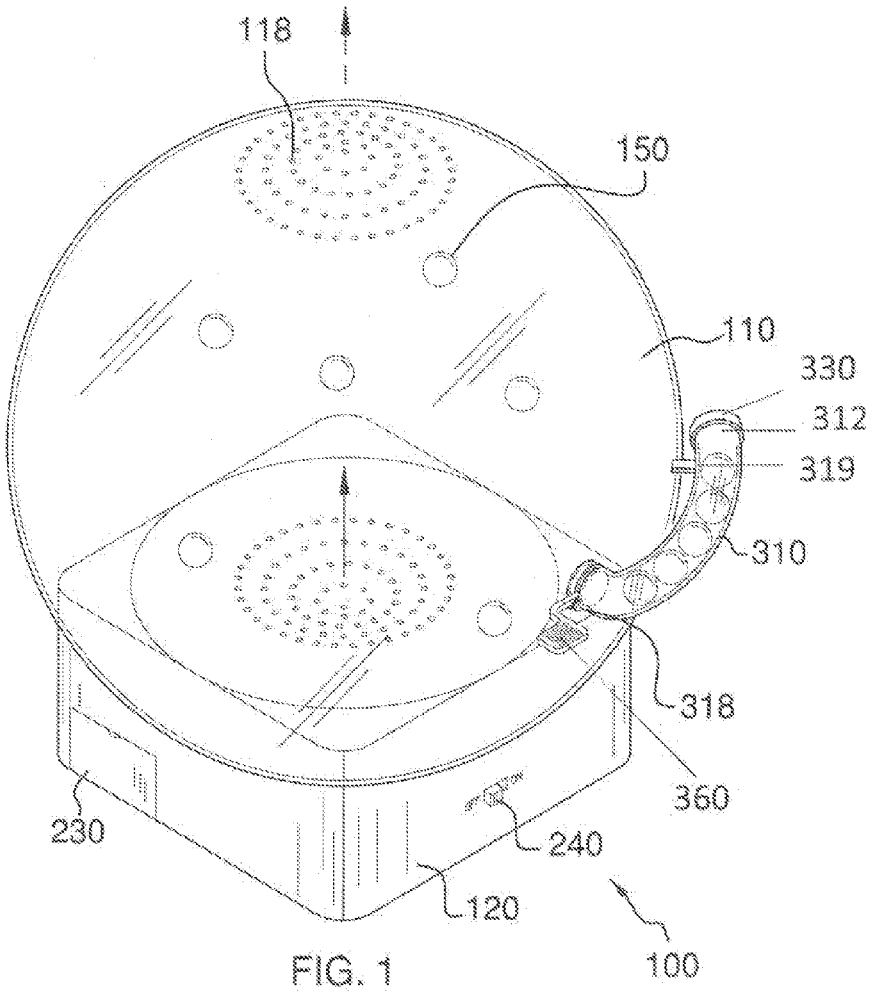
FIG. 1 is a perspective view of the random number selector device of the present invention.
Figure 3:
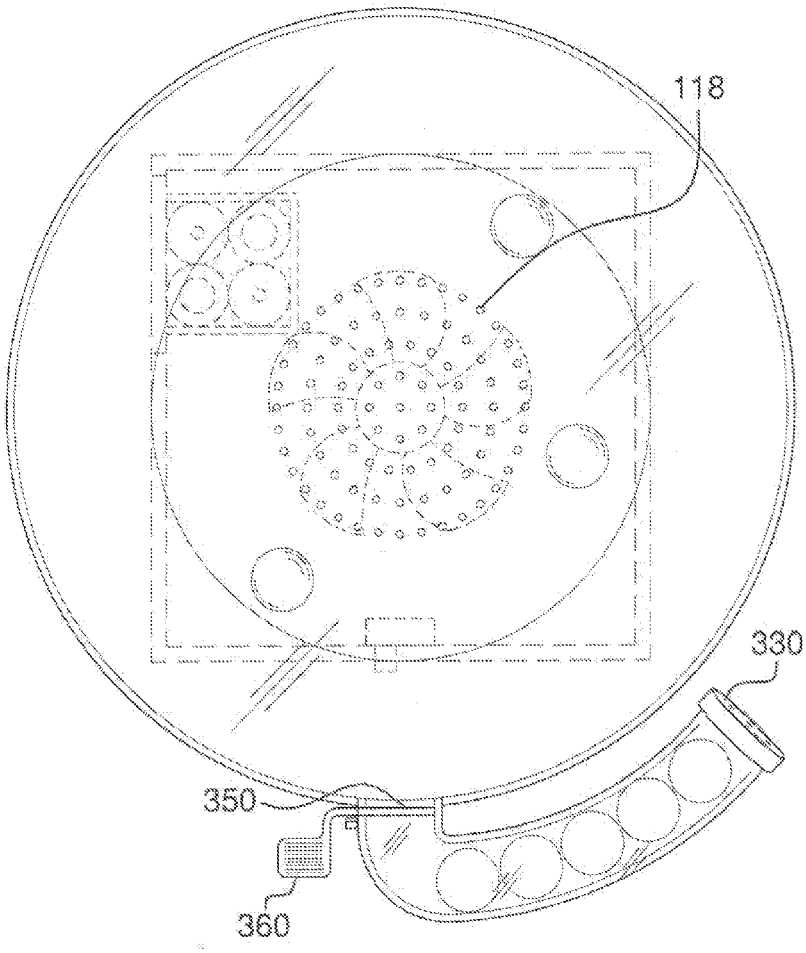
FIG. 3 is a top view of the random number selector device of the present invention.
Figure 4:
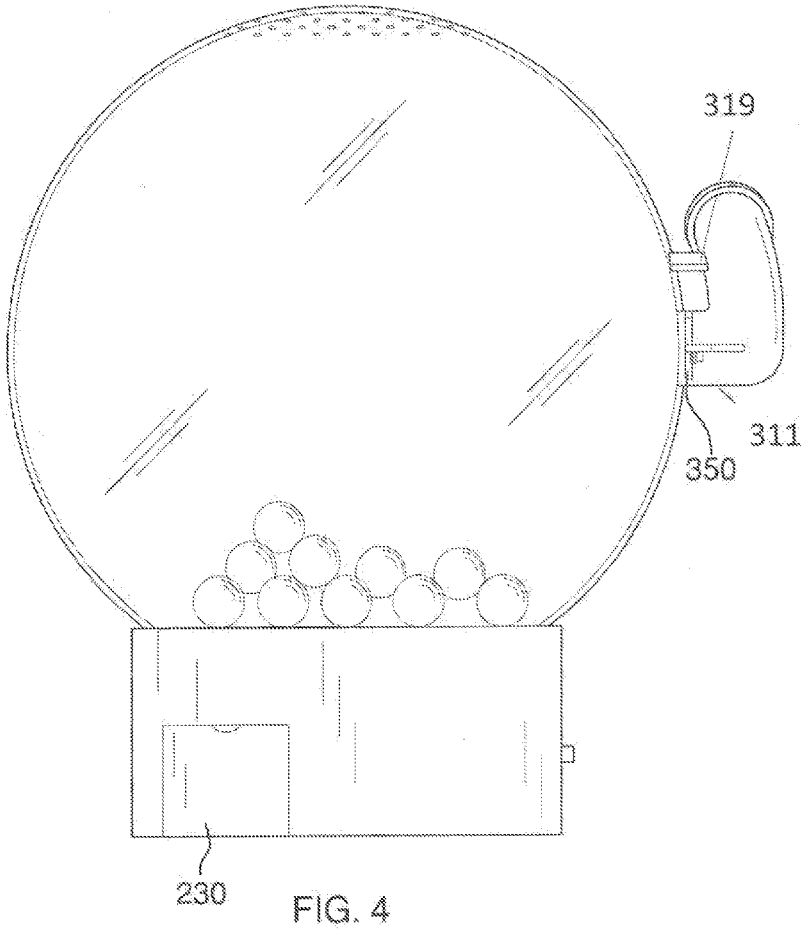
FIG. 4 is a side view of the random number selector device of the present invention.
Figure 5:
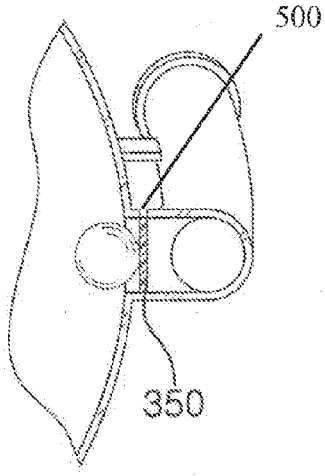
FIG. 5 is a partial back view of the random number selector device of the present invention, particularly showing a partial cut 500 is disposed on the first end of the selector tube 310, which the tube cover 350 to be inserted therein to be in the first position.

The device 100 of the present invention further comprises a hollow selector tube 310 that extends out of the globe 110, for example a side area of the globe 110. For example the first end 311 of the selector tube 310 is attached to, the globe 110. The selector tube 310 is fluidly connected to the inner cavity of the globe 110. The selector tube 310 allows passage of a ball 150 out from the inner cavity of the globe 110 (e.g., the selector tube 310 is sized to allow passage of a ball 150 from the inner cavity of the globe 110 through the selector tube 310 and out of the second end 312 of the selector tube 310). In some embodiments, the selector tube 310 is removably attached to the globe 110. In some embodiments, the selector tube 310 is pivotally attached to the globe 110, allowing a user to position the tube 310 appropriately. The selector tube 310 may be generally curved (e.g., as shown in FIGS. 1 and 3), for example the selector tube may be curved with the contour of the shape of the globe 110. In some embodiments, a connector piece 319 connects, an area of the selector tube 310 at or near the second end 312 to the globe 110 (e.g., for stability).

As shown in FIG. 2, in some embodiments, a cap 330 is disposed on the second end 312 of the selector tube 310. In some embodiments, one or more cap apertures are disposed in the cap 330 allowing air to flow out from the tube 310. The cap 330 may be removably attached to the outer end of the selector tube 310.

A tube cover 350 is disposed in the globe 110 at the intersection of the first end 311 of the selector tube 310 and the globe 110. The tube cover 350 functions to temporarily block access to the selector tube 310. The tube cover 350 can pivot between a first position and a second position respectively allowing and preventing access to the selector tube 310 (e.g., not covering and covering the first end 311 of the selector tube 310, respectively). The tube cover 350 is biased in the second position caused by a spring 318 (e.g., the tube cover 350 is a spring-loaded cover). A release lever 360 is attached to the tube cover 350. The release lever 360 extends outwardly from the selector tube 310 and globe 110. The release lever 360 can be pushed, causing the tube cover 350 to move to the first position (allowing access to the selector tube 310). When the release lever 360 is released, the spring 318 causes the tube cover 350 to move back to the first position (preventing access to the selector tube 310).

To use the device 100, the balls 150 are place in the inner cavity of the globe 110. The device 100 is turned on (via the control switch 240) and air is directed through the inner cavity of the globe 110. The air causes the balls 150 to move around randomly. Because the tube cover 350 covers the selector tube 310, no balls 150 can escape. If a user presses the release lever 360 to move the tube cover 350 to the first position, balls can escape into the selector tube 310, creating a series of randomly chosen numbers for a lottery or other game. After selecting balls, the device can be turned off and the release lever 360 can be moved to allow the balls to return into the globe 110 to be ready for the next use.

Without wishing to limit the present invention to any theory or mechanism, it is believed that the present invention is advantageous because the present invention comprises a tube, release lever, and battery compartment, and the slant of the tube allows for easy ball release back into the globe.

The disclosures of the following U.S. Patents are incorporated in their entirety by reference herein: U.S. Pat. No. 4,508,346; U.S. Pat. No. 4,786,056; U.S. Pat. No. 5,419,557; U.S. Pat. No. 6,145,836; U.S. Pat. No. 4,846,476; U.S. Design Pat No. D331,782; U.S. Pat. No. 5,062,635.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A random number selector device comprising:

(a) a generally spherical and hollow globe 110, wherein a plurality of globe air apertures 118 is disposed in a top end of the globe 110 and a bottom end of the globe 110 is either open or comprises globe air apertures;

(b) a plurality of balls 150 of equal weight and size, each ball 150 is labelled with a number, each ball 150 is housed in an inner cavity of the globe 110;

(c) a base 120 for supporting the globe 110, a concave indentation 126 is disposed in a top surface of the base 120 to accommodate the bottom end of the globe 110, a plurality of side apertures is disposed in a side surface of the base 120, a plurality of base air apertures 128 is disposed in the concave indentation 126, the base air apertures 128 allow flow of air from the inner cavity of the base 120 into the inner cavity of the globe 110 whereupon air can exit the globe 110 via the globe air apertures 118 in the top end of the globe 110, wherein air flow in the inner cavity of the globe 110 causes the balls 150 to randomly move around;

(d) a fan 210 disposed in an inner cavity of the base 120, a motor 220 is operatively connected to the fan 210, the fan 210 and motor 220 together function to draw air into the base 120 via the side air apertures 129 and push air out of the base 120 via the base air apertures 128;

(e) a hollow selector tube 310 having a first end 311 and a second end 312, the first end 311 being attached to a side area of the globe 110, the selector tube 310 is fluidly connected to the inner cavity of the globe 110, the selector tube 310 is sized to allow passage of a ball 150 from the inner cavity of the globe 110, a cap 330 with apertures is disposed at the second end 312 of the selector tube 310;

(f) a tube cover 350 disposed in the globe 110 at an intersection of the first end 311 of the selector tube 310 and the globe 110, the tube cover is sized to fit inside the selector tube 310, the tube cover 350 can pivot between a first position and a second position respectively allowing and preventing access to the selector tube 310, the tube cover 350 is biased in the second position caused by a spring 318, wherein the selector tube 310 has a partial cut 500 on it at the first end that allows the tube cover 350 to be inserted therein to be in the first position, the partial cut 500 is disposed on the selector tube 310 and exterior to the globe 110, the tube cover is in the second position when the tube cover 350 is pulled outside of the selector tube 310;

wherein when the tube cover 350 is in the first position to allow air access from the globe to the selector tube 310, the apertures on the cap disposed at the second end 312 of the selector tube 310 advantageously increases airflow from the lobe 110 into the selector tube 310 to facilitate directing the balls 150 into the selector tube 310;

(g) a release lever 360 attached to the tube cover 350, the release lever 360 can be pushed causing the tube cover 350 to move to the first position and when the release lever 360 is released the spring 318 causes the tube cover 350 to move back to the second position;

wherein the released lever 360 is pivotably mounted on the selector tube 310 at a location adjacent to the partial cut 500; and (h) a power switch 240 for turning the device on and off.

2. The device of claim 1 further comprising a cap 330 disposed on the second end 312 of the selector tube 310.

3. The device of claim 2, wherein the cap 330 is removably attached to the second end 312 of the selector tube 310.

4. The device of claim 1, wherein the motor 220 is operatively connected to a power source.

5. The device of claim 4, wherein the power source is a battery or an electrical outlet.

6. The device of claim 1, wherein the selector tube 310 is removably attached to the globe 110.

7. The device of claim 1, wherein the selector tube 310 is pivotally attached to the globe 110.

8. The device of claim 1, wherein the selector tube 310 is generally curved.

9. The device of claim 1 further comprising a connector piece 319 connecting an area of the selector tube 310 at or near the second end 312 of the selector tube 310 to the globe 110.

* * * * *